US007461667B2

(12) United States Patent
Ko

(10) Patent No.: US 7,461,667 B2
(45) Date of Patent: Dec. 9, 2008

(54) RIB STRUCTURE OF A TWO-LAYER COVER UMBRELLA

(76) Inventor: Chin Sung Ko, No. 38, Din Nan Road, Ho Mei Town, Changhua Shien (TW)

( * ) Notice: Subject to any disclaimer, the term of this patent is extended or adjusted under 35 U.S.C. 154(b) by 0 days.

(21) Appl. No.: 11/507,432

(22) Filed: Aug. 22, 2006

(65) Prior Publication Data

US 2008/0047595 A1 Feb. 28, 2008

(51) Int. Cl.
*A45B 25/22* (2006.01)
*A45B 25/02* (2006.01)

(52) U.S. Cl. ..... 135/31; 135/25.31; 135/33.7

(58) Field of Classification Search ..... 135/23, 135/25.1, 25.31, 31, 32, 33.7
See application file for complete search history.

(56) References Cited

U.S. PATENT DOCUMENTS 5,063,953 A * 11/1991 Wu ..... 135/25.3
5,235,998 A * 8/1993 Liu ..... 135/25.3
5,337,770 A * 8/1994 Wang ..... 135/25.3
5,472,006 A * 12/1995 Kuo et al. ..... 135/31
5,787,912 A * 8/1998 Wu ..... 135/29
6,095,171 A * 8/2000 Lin et al. ..... 135/33.7
6,164,303 A * 12/2000 Lin et al. ..... 135/29
6,170,498 B1 * 1/2001 Wu ..... 135/24
6,202,661 B1 * 3/2001 Okuda ..... 135/29
6,336,464 B1 * 1/2002 Ko ..... 135/29
6,736,151 B2 * 5/2004 Lin et al. ..... 135/31
7,174,906 B2 * 2/2007 Ko ..... 135/25.3
2007/0209691 A1 * 9/2007 Lin ..... 135/32

* cited by examiner

*Primary Examiner*—Winnie Yip
(74) *Attorney, Agent, or Firm*—Rosenberg, Klein & Lee

(57) ABSTRACT

The invention relates to a rib structure of a two-layer cover umbrella, which mainly includes an elastic rib having an inner folded end. A connector of a related primary rib of the umbrella is provided with an aperture, for that the inner folded end of the elastic rib is penetrated into the aperture and connected with a lateral rod of the connector. The elastic rib will be then extended outward alone the upper surface of the primary rib smoothly for connecting the upper cover and providing a utilized umbrella with two covers.

2 Claims, 6 Drawing Sheets

RIB STRUCTURE OF A TWO-LAYER COVER UMBRELLA

BACKGROUND OF THE INVENTION

As shown in FIG. 1, a two-layer cover umbrella is popular for releasing wind pressure by use of the space between two covers. This two-layer cover umbrella can then prevent the frame from damage by strong wind. The conventional structure usually includes a branch rib (1), which has inner end a connector (11) as shown in FIG. 2 to 4. A rivet (12) is used to joint the connector (11) with a primary rib (2). Hence, the branch rib (1) is capable of connecting the upper cover. A drawback of this umbrella is that the connecting strength between the branch rib (1) and the primary rib (2) is weak. If strong wind occurs, the branch rib (1) will be still broken. Further, the connector (11) is obviously projected as a step from the primary rib (2). The upper cover will be easily broken and the outlook of the umbrella is not good.

The present invention is to provide an improved rib structure for using in a two-layer cover umbrella, which can solve the problem of the prior art and obtains improvement and utilization. Now, accompanying with the following drawings, the character of the present invention will be described here and after.

DETAILED DESCRIPTION OF THE PREFERRED EMBODIMENT

Figure 1:
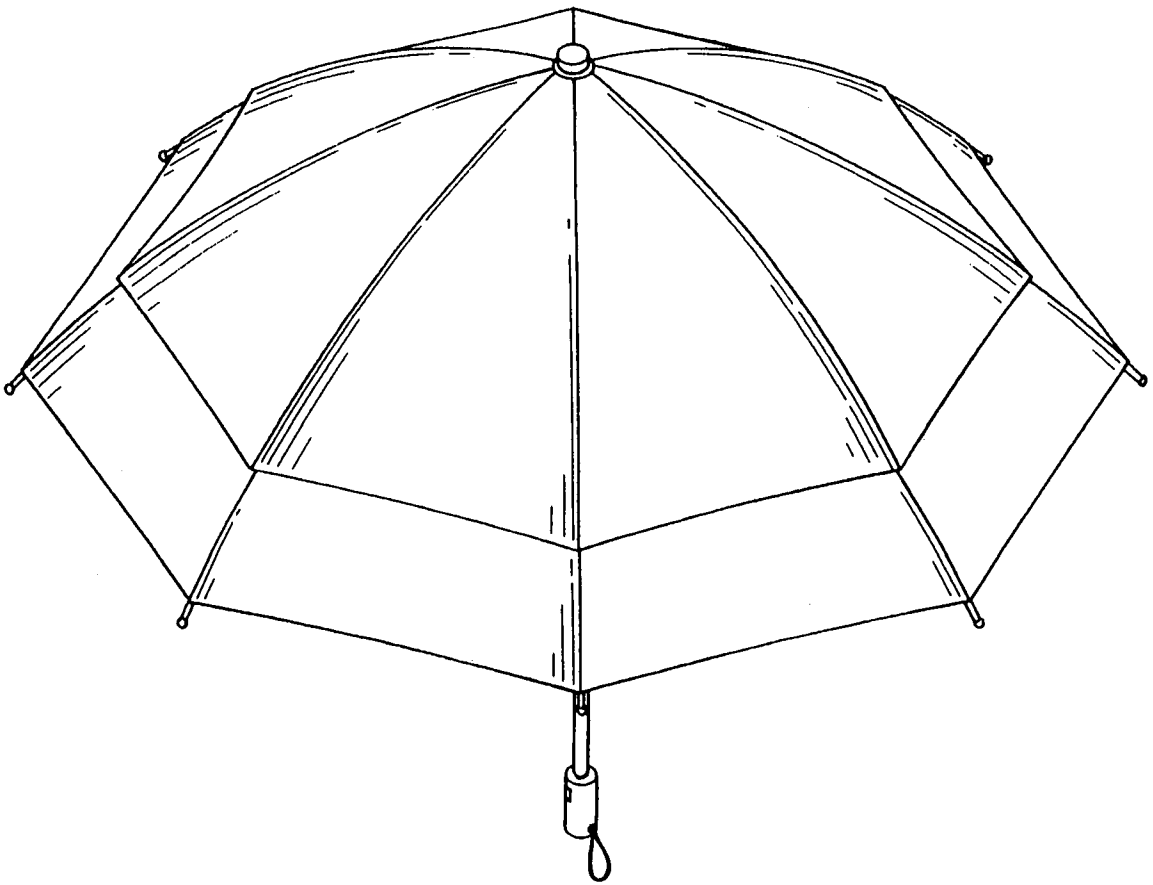
FIG. 1 is a perspective view showing a popular two-layer cover umbrella.
Figure 2:
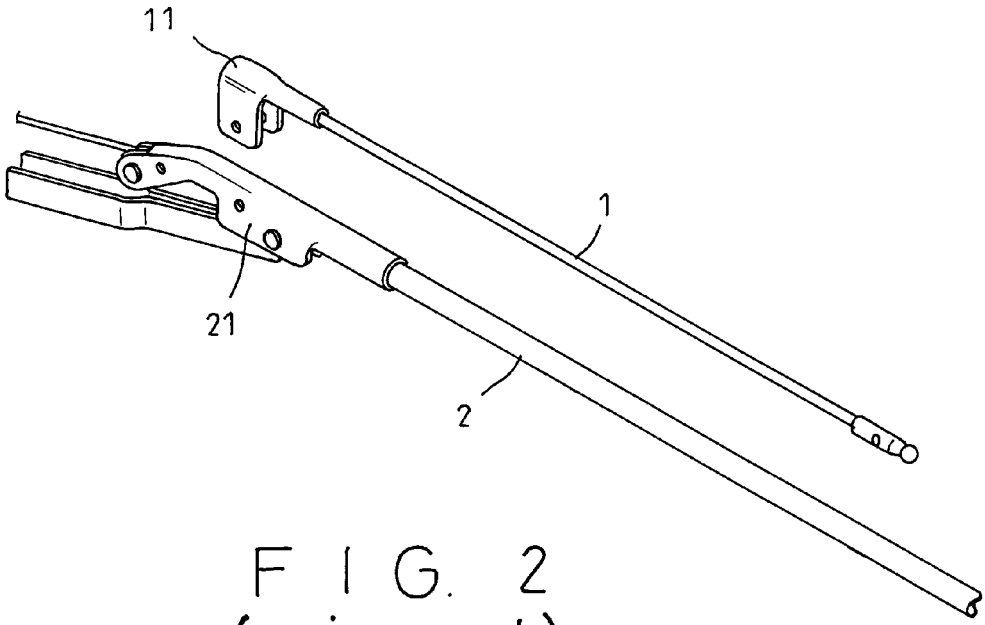
FIG. 2 (prior art)
FIG. 2 is an exploded perspective view showing a conventional rib structure of a two-layer cover umbrella.
Figure 3:
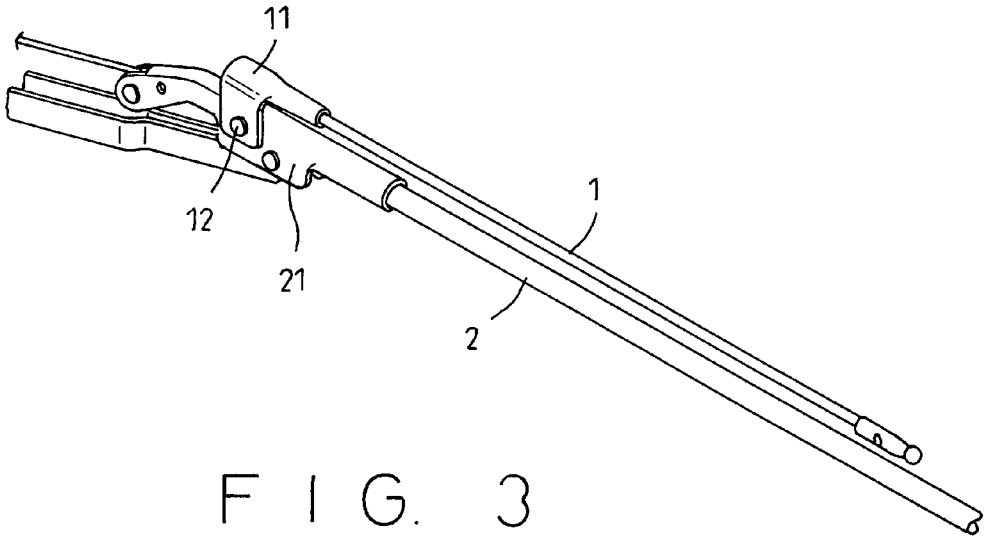
FIG. 3 (prior art)
FIG. 3 is an assembled view of FIG. 2.
Figure 4:
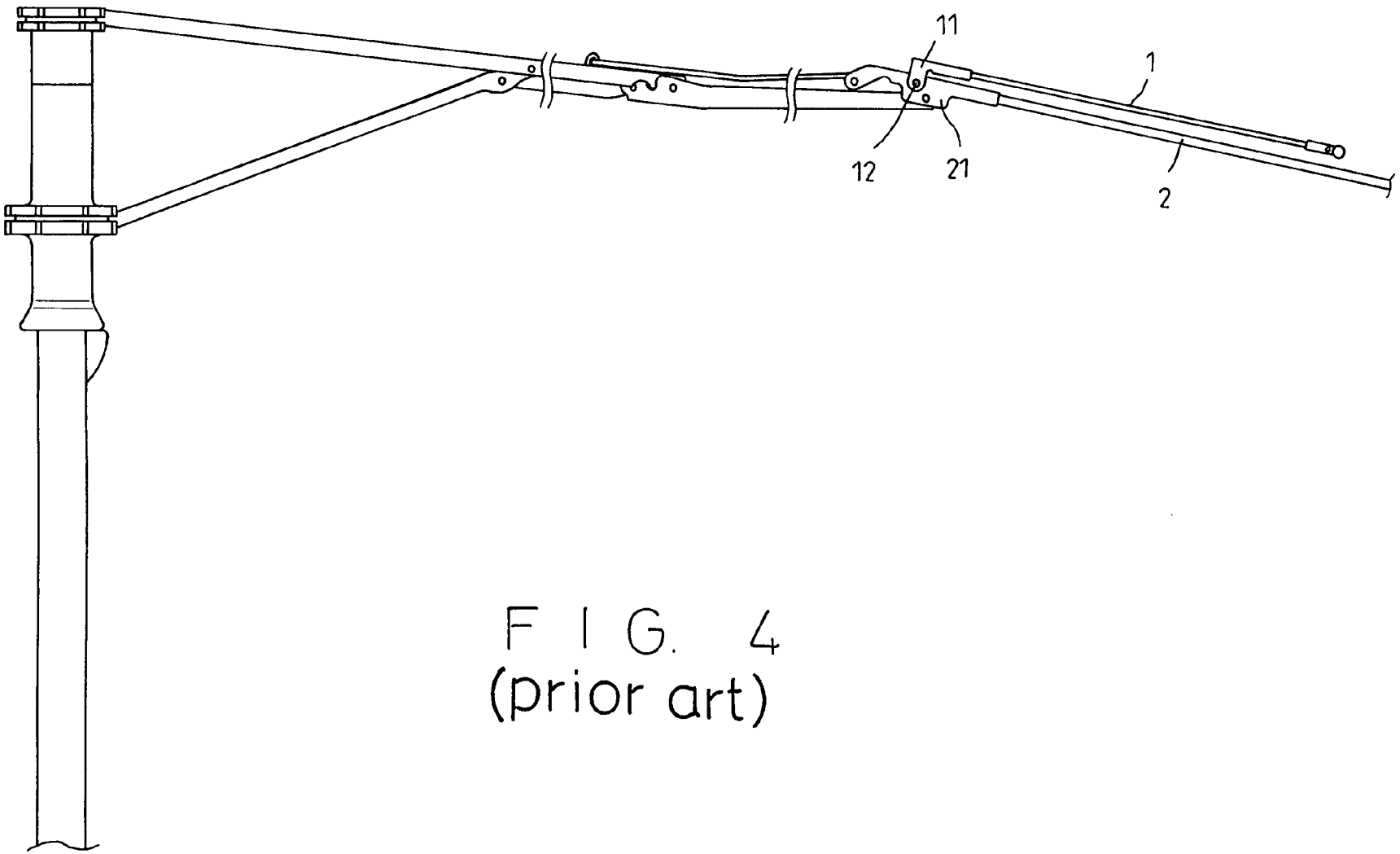
FIG. 4 (prior art)
FIG. 4 is a plan view of FIG. 3 with the frame of the umbrella in opening state.
Figure 5:
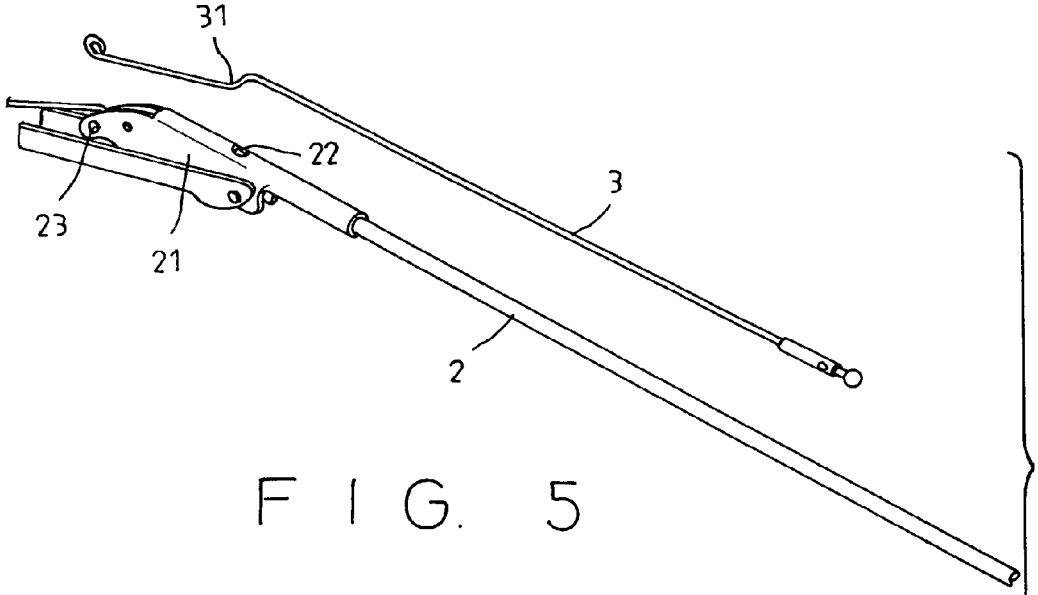
FIG. 5 is an exploded perspective view showing a rib structure of a two-layer cover umbrella according to the present invention.
Figure 6:
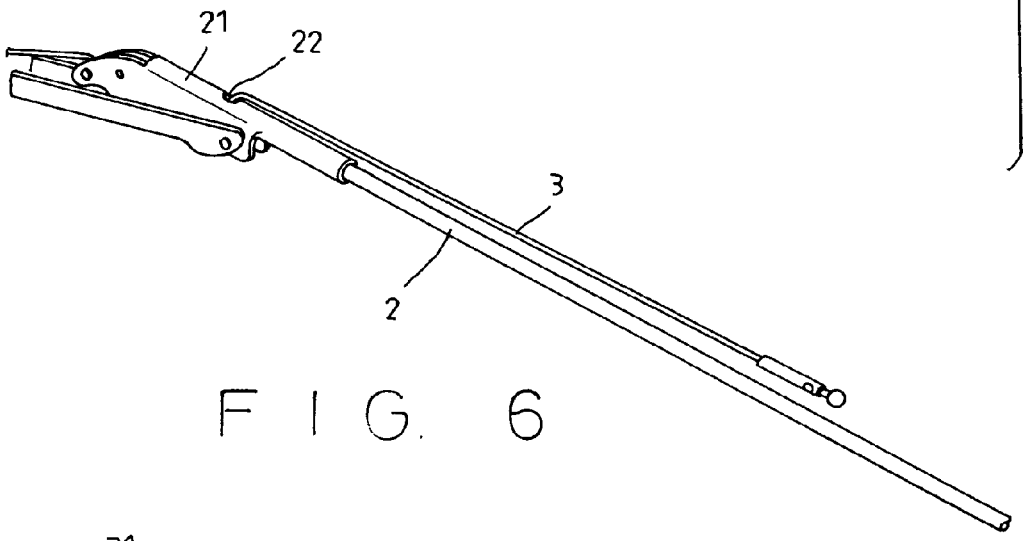
FIG. 6 is an assembled view of FIG. 5.
Figure 7:
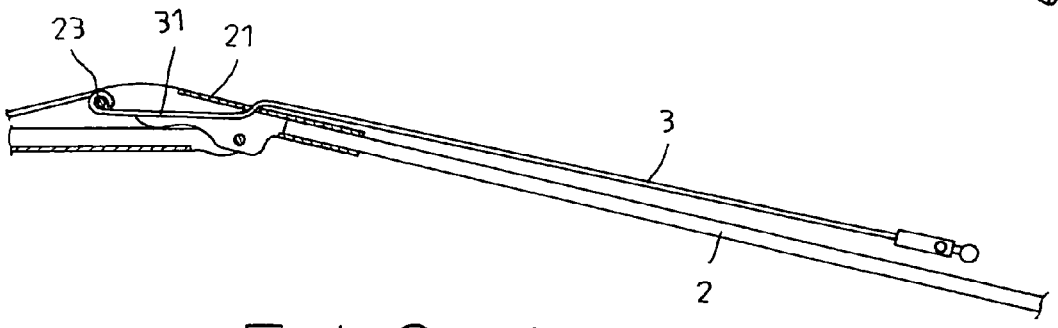
FIG. 7 is a cross-sectional plan view of FIG. 6.
Figure 8:
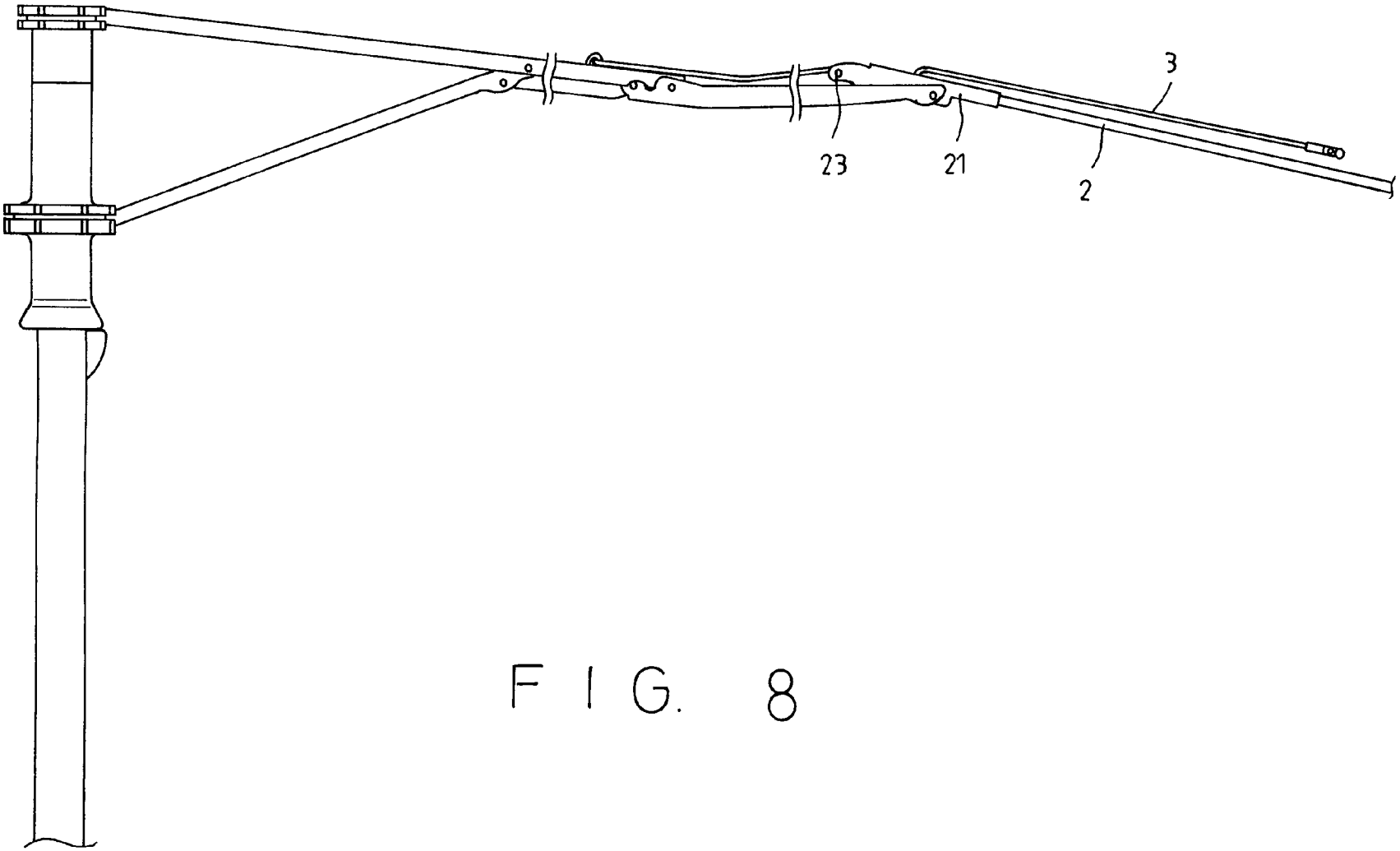
FIG. 8 is plan view of FIG. 6 with the frame of the umbrella in opening state according to the present invention.

Referring to FIG. 5 to 8, the present invention relates to an improved rib structure for using in an umbrella having two-layer covers. The invention mainly includes an elastic rib (3), which has an inner folded end (31). A connector (21) of a related primary rib (2) is provided with an aperture (22). The inner folded end (31) of the elastic rib (3) is penetrated into the aperture (22) and connected with a lateral rod (23) of the connector (2). The elastic rib (3) is then extended outward alone the upper surface of the primary rib (2) smoothly. Since the elastic rib (3) in this invention is a single structure, which has a better strength for resisting strong wind. It can be understood that the present invention overcomes the drawback of prior art.

In use, the elastic rib (3) lays on the primary rib (2) smoothly. The cover of the umbrella will be also smooth that provides a beautiful outlook and the cover will not be damaged at this state. Moreover, the connection of the present invention is very convenient that facilitates the manufacturing of the umbrella.

Figure 9:
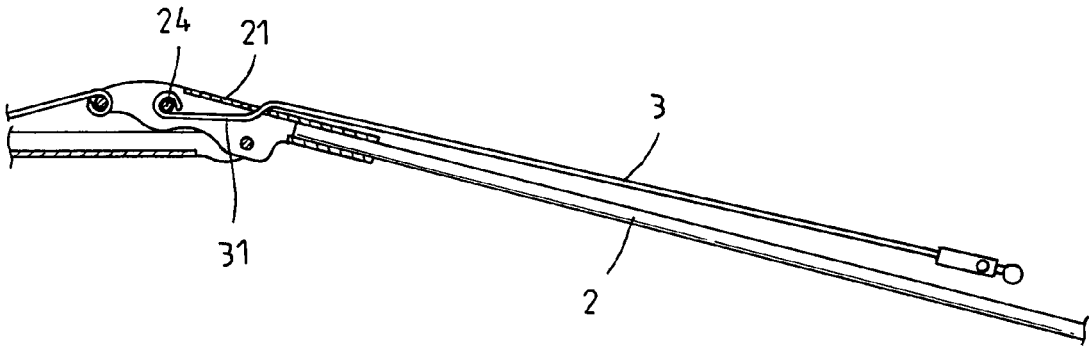
FIG. 9 is a cross-sectional plan view relating FIG. 7 showing a modified structure according to the present invention.

It is known that the above embodiment is only exemplary. There are possibly modified embodiments under the same merit of this application. Such as shown in FIG. 9, the connector (2) is provided a rivet (24) therein for connecting with the inner folded end (31) of the elastic rib (3). It can reach a similar effect as the above mention. Hence, the present invention obviously obtains improvement and should be allowed for a patent.

I claim:

1. A two-layer cover umbrella including a rib structure, the rib structure comprising:

an elastic rib having an inner folded end, a primary rib, a connector provided with an aperture in an upper surface thereof, said connector forming a first section and a sleeve integrally formed with said first section, said sleeve of said connector receiving said primary rib, wherein the inner folded end of the elastic rib is inserted into the aperture and has a folded portion extending downward and rearward to a rear side of said first section opposite the sleeve and is connected by a lateral rod within said first section of said connector, and the elastic rib being thereby extended outward along an upper surface of the primary rib.

2. The rib structure of a two-layer cover umbrella as claimed in claim 1, wherein the connector includes the lateral rod therein for connecting with said inner folded end of the inner portion of said elastic rib.

* * * * *